United States Patent [19]

Hughes et al.

[11] Patent Number: 4,887,815

[45] Date of Patent: Dec. 19, 1989

[54] LOW SWING WEIGHT GOLF CLUB SET

[76] Inventors: James W. Hughes; James P. Hughes, both of #1 Lynda, Texarkana, Tex. 75503

[21] Appl. No.: 265,936

[22] Filed: Nov. 2, 1988

Related U.S. Application Data

[63] Continuation-in-part of Ser. No. 106,276, Oct. 9, 1987, abandoned, which is a continuation-in-part of Ser. No. 814,780, Dec. 30, 1985, abandoned.

[51] Int. Cl.[4] ..... A63B 53/14; A63B 53/00

[52] U.S. Cl. ..... 273/77 A; 273/81 A

[58] Field of Search ..... 273/77 R, 77 A, 81 A, 273/169, 170, 171, 172

[56] References Cited

U.S. PATENT DOCUMENTS

| | | | |
|---|---|---|---|
| 1,953,916 | 4/1934 | Adams | 273/77 A |
| 3,577,771 | 5/1971 | Solhelm | 273/77 A |
| 3,698,239 | 10/1972 | Everett | 273/77 A |
| 3,963,236 | 6/1976 | Mann | 273/77 A |
| 4,058,312 | 11/1977 | Stuff et al. | 273/81 A |
| 4,690,407 | 9/1987 | Reisner | 273/81 A |

*Primary Examiner*—George J. Marlo

*Attorney, Agent, or Firm*—Finnegan, Henderson, Farabow et al.

[57] ABSTRACT

A set of numbered golf clubs made from a plurality of progressively lofted clubs, each club having a club head, a shaft fixed at one end to the club head, and a grip fixed to the shaft at the other end. A counterweight is positioned at the distal end of the golf club opposite the club head, and the length of the shaft and the weight of the head, the shaft, the grip, and the counterweight of each club are selected so that each club within the set has a lorythmic swing weight of less than A minus 6 points, each club preferably having a shaft of the same flexing properties. The club heads with the counterweight system provides the user with increased stability, control and power.

30 Claims, 2 Drawing Sheets

LOW SWING WEIGHT GOLF CLUB SET

BACKGROUND OF THE INVENTION

This application is a continuation-in-part of U.S. application No. 106,276, filed on Oct. 9, 1987, now abandoned, which in turn is a continuation-in-part of U.S. application Ser. No. 814,780, filed on Dec. 30, 1985, now abandoned.

FIELD OF THE INVENTION

The present invention relates generally to golf clubs and more specifically to a set of clubs having low swing weights and a counterweight and arch-weight system to permit the golfer using the clubs to have increased control without loss of power. A counterweight together with an arch-weight formula has been used to convert standard conventional clubs to a much lower swing weight, without any loss in club head arch-weight.

DESCRIPTION OF THE PRIOR ART

Several different types of designs of golf clubs have been developed in the past. Golf clubs are normally sold in sets of woods and irons, and the sets of golf clubs in the past have had various configurations and swing weights. Golf club sets typically include a wood-type driver, one or more additional wood-type clubs (such as a No. 3 and No. 4 wood) and a set of irons (often progressing fron the No. 3 iron through a No. 9 iron). A set may also include higher wood-type clubs and a wedge (No. 10) and a sand wedge (No. 11) iron-type club.

The prior art includes patents which have suggested the inclusion of an additional weight to balance the club in some manner. Examples of such efforts are shown in U.S. Pat. No. 1,210,182 to Lynch; U.S. Pat. No. 1,696,462 to Victor; U.S. Pat. No. 2,782,035 to East; U.S. Pat. No. 3,075,768 to Karns; and U.S. Pat. No. 4,690,407 to Reisner. In addition, there have been attempts to design matched clubs having the same total club weight and particular weight distributions. For example, such systems are described in U.S. Pat. No. 3,698,239 to Everett; U.S. Pat. No. 4,058,312 to Stuff et al. and U.S. Pat. No. 4,415,156 to Jorgenson. To applicants' knowledge, none of the above systems have been successful in the market.

Golf clubs are manufactured and marketed as having specified swing weights, according to standards well-known and accepted in the art. Typically, the swing weights are designated according to a "lorythmic scale." Swing weights also can be designated according to an "official" scale. As described below, there is a direct relationship between these two scales, and it is possible to convert from one scale to the other.

To understand the concept of a golf club swing weight generally, devices used to measure the swing weight of clubs are shown in FIGS. 6 and 7. In the device shown in FIG. 6, a sliding weight 36 is adjusted to balance a golf club on the pivot point 34. As shown in that figure, a golf club shown generally as 9 is positioned on a scale 30 including a stop 32 against which the end of the golf club shaft is positioned. The scale includes a pivot point 34 on its bottom and a sliding weight 36 which slides along a scale. The swing weight is determined by the degree of movement of the sliding weight that is necessary to bring the club into balance on the pivot point. The degree of movement and reading on the scale can be correlated to determine the lorythmic swing weight. Scales of this type often provide a reading of what is known in the art as an "official" swing weight.

The device shown in FIG. 7 is described in U.S. Pat. No. 3,557,771 to Solheim and is sold by Karsten Manufacturing Company of California. The Karsten scale has a main elongated body 50 having at its left end a stop 52 and having at its right end a fulcrum arm 54. The body 50 further includes a counterweight 56, a slide weight 58, an elongated scale 60 and a rocker or pivot point 62. In operation, a club 9 is placed on the scale, as shown in FIG. 7, and then the slide weight 58 is moved until the scale and club are balanced on the rocker. The "lorythmic" swing weight is then read from the scale by reading the lorythmic swing weight at the right edge of the slide weight.

As is known in the art, the swing weight of a club can be described in terms of the "official" swing weight system in ounces or the "lorythmic" swing weight system in alphanumeric characters. The reading in one system can be readily converted, precisely, to the other system, as is well known in the art. An explanation of the systems and the conversion from one system to the other is described in "Swingweight Measurement," a publication copyrighted by Mr. Lloyd W. Rittenhouse in 1977 and hereby incorporated by reference. As explained in more detail in Mr. Rittenhouse's article the lorythmic scale is based upon a 14-inch fulcrum and measures swing weight directly in the standard letter-number terminology (such as D+3) familiar to most golfers. The officical scale is based upon a 12-inch fulcrum and measures swing weight in ounces. The conversion between the two systems depends upon the total, overall weight of the club. By knowing the total weight of the club (the weight of all elements of the club including the grip, shaft, club head, etc.), a precise correlation can be made between the two systems.

In general terms, swing weight may be defined as a measure of the weight distribution of a golf club, about a fixed point or axis located at a certain specified distance from the grip end of the club. In the official scale, this distance is 12 inches. In the lorythmic scale, the distance is 14 inches. More specifically, the swing weight is the product of the club's weight and the distance from the club's center of gravity to the axis. This measurement, technically, would be expressed in "inch-ounces." Since the fulcrum distance on the official scale is 2 inches shorter than it is on the lorythmic scale, the swing weight (when measured in inch-ounces) on the official scale is consequently greater by the product of two inches times the total weight of the club.

For the official scale, the swing weight in inch-ounces is simply the scale reading in ounces times the 12 inch fulcrum length. For the lorythmic scale, C-0 is an arbitrary point of reference at which the swing weight is 196 inch-ounces. Each point on the lorythmic scale represents 1.75 inch-ounces, and each letter (A through D) has ten points. There are ten points, for example, between C-0 and D-0. Therefore, a D+2 lorythmic reading is 12 points heavier than C-0 and is $12 \times 1.75$ plus 196 inch-ounces, or a total of 217 inch-ounces. By knowing the above relationships, it is possible to convert from one scale to the other.

None of the patents previously described and none of the golf clubs sets previously known to applicants have been able to provide a correlated set of golf clubs which produce low swing weight below the A range on the lorythmic scale. Moreover, none of the lightweight clubs on the market were able to achieve lower swing weights without reducing the club head arch-weight of the club. Most of the conventional clubs now on the market have a swing weight in the range of C+8 to D+3.

To applicants' knowledge, no one has provided a club set with provides the improved control of a low swing weight club in combination with the increased power of a high swing weight club. Conventional club sets with swing weights in the range of C+8 to D+3 provide a golfer with increased power but are significantly more difficult to control because the momentum of the club head tends to throw the golfer's swing out of line when he attempts to increase the club's velocity. On the other hand, conventional clubs having lower swing weights provide increased control and velocity only by sacrificing power by reducing club head weight. As a consequence, clubs with lower swing weights have had limited success.

In applicants' view, the longer and more flexible shafts of conventional woods present an additional problem. With conventional clubs, such longer and more flexible wood type shafts are considered to be necessary in order to generate velocity of the club head. The iron clubs have shorter and stiffer shafts. The long and flexible shafts used with conventional woods are more difficult to control.

SUMMARY OF THE INVENTION

Applicants through continued research, development and testing have invented a set of golf clubs which overcomes the above problems and represents a significant departure from and improvement over the prior art. The present invention, because of the counterweight and arch-weight conversion formula applied to a conventional set of clubs, produces a set of clubs that can generate more club head velocity without loss in what the applicants have termed the club head arch-weight. The meaning and significance of club head arch-weight will be explained in detail below.

The object of the present invention is to provide a set of golf clubs, consisting preferably of a driver through a No. 11 iron (sand wedge), without loss in club head arch-weight and having a low swing weight below the positive A value on the lorythmic scale. The entire set of clubs also preferably has iron type, less flexible shafts. The No. 10 and No. 11 clubs are the pitching wedge and sand wedge type clubs, respectively. The other clubs consist of the driver through the No. 9 club, and these clubs provide progressively less distance as the number of the club increases.

The present invention can be applied to clubs having wood-type and iron-type heads. Standard clubs typically include two to three wood-type heads and at least seven iron-type heads. The present invention can be applied to such a set of clubs. As detailed more thoroughly below, the club heads of the driver through the No. 3 club may be configurated to have iron-type heads or wood-type heads. If the driver through No. 3 club are configured to have iron-type heads, then the entire set of clubs will have iron-type heads. In addition, an entire set of clubs made according to the invention may have an integrated design progressing from the wood-type head to an iron-type head, as the club head number increases.

Another object is to provide a set of golf clubs which includes a counterweight or mass at the distal end of each golf club opposite the club head. This counterweight not only lowers the swing weight of the clubs, thereby producing higher potential club head velocity, but is of sufficient weight, considering the length of the shaft and the weight of the club head, to offset any loss in club head arch-weight resulting from the use of a club having a lighter club head weight.

Still another object is to provide a set of clubs in which the club heads of the respective clubs weigh significantly less than conventional club heads, the lighter weight being computed by use of a conversion formula developed by the inventors and described in this specification.

Another object is to provide a set of golf clubs which can be easily controlled by the user and which promote a proper swing. Yet another object is to provide a set of clubs which can be swung at greater club head velocities without creating increased forces that tend to throw the clubs out of the proper swing line.

Another object is to reduce torque in the shaft. The extremely low swing weight and club head weight of the clubs of the present invention greatly reduces the tendency of the toe of the club head from bending and twisting the shaft during the swing.

Another object is to provide a set of clubs which are progressively integrated in length, loft, head weight, and swing weight.

Additional objects and advantages of the invention will be set forth in part i the description which follows, and in part will be obvious from the description, or may be learned by practice of the invention described herein. The objects and advantages may be realized and attained by means of the elements and relationships particularly pointed out in the appended claims.

To achieve the objects and in accordance with the purposes of the invention, as embodied and broadly described herein, the set of golf clubs of the present invention comprises a plurality of progressively lofted clubs, each club having a club head, a shaft fixed at one end to the club head and a grip fixed to the shaft at the other end, a counterweight positioned at the distal end of the shaft opposite each of the respective club heads, said counterweight weighing at least 90 grams, the weight of the club head of each club progressively increasing as the number of the club increases, the weight of the club head falling within the range of no greater than 195.8 and no less than 172.6 grams for the driver and no greater than 265.5 and no less than 242.3 grams for the 9 iron, and the swing weight of the clubs progressively increasing as the number of the club increases, the swing weight of the clubs falling within the range of less than AO minus 16 points on the lorythmic scale for the driver and less than AO minus 6.75 points on the lorythmic sale for the 9 iron.

In the preferred embodiment, each numbered club of the set from the driver 1 to number 9 club has a different total weight and a different swing weight. More preferably, the driver through number 9 clubs progressively increase in total weight, progressively increase in club head weight, progressively decrease in shaft length, and progressively increase in lorythmic swing weight. Preferably, the counterweight is symmetrically positioned about the longitudinal axis of the shaft of each respective club, and the shaft of each club has substantially the same degree of flexibility, preferably a stiffness equal to that of standard iron-type shafts.

It is understood that both the foregoing general description and the following detailed description are exemplary and explanatory only and are not restrictive of the invention, as claimed.

The accompanying drawings, which are incorporated in and constitute a part of this specification, illustrate an embodiment of the invention and, together with the description, serve to explain the principles of the invention.

DETAILED DESCRIPTION OF THE PREFERRED EMBODIMENTS

Figure 1:
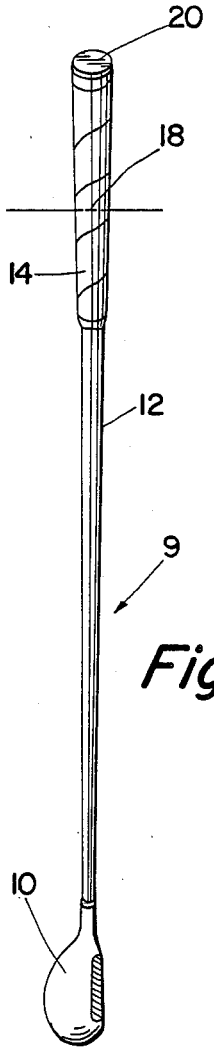
FIG. 1 is a perspective view of a wood-type club of a set according to the present invention.

Reference will now be made in detail to the present preferred embodiments of the invention, examples of which are illustrated in the accompanying drawings, wherein like reference characters designate like or corresponding parts throughout the several figures.

Figure 2:
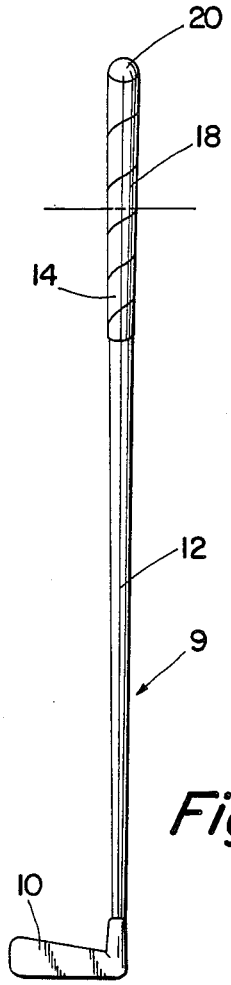
FIG. 2 is a perspective view of a iron-type club according to the present invention.

The present invention is directed to a set of golf clubs including a a driver, or driving-iron, and the rest of the set of numbered clubs. The set preferably includes the driver through 9, and most preferably includes the driver through 11. All of the clubs preferably have the same iron-type shafts which are less flexible than wood-type shafts. The driver, No. 1, 2 and 3 club may have either a conventional iron-type head configuration, such as shown in FIG. 2, or a conventional wood-type head configuration, such as shown in FIG. 1. The No. 4 through No. 9 clubs in either such set would have iron-type designs. In addition, the set of clubs according to the present invention may have an integrated, progressive design starting from a wood-type head for the driver and progressively changing to iron-type heads for the higher numbered clubs. The club heads of the No. 4 through No. 11 clubs all have iron-type clubs heads or a club head of progressive design. The No. 10 club is analagous to a pitching wedge, and the No. 11 iron is analagous to a sand wedge.

Each of the respective golf clubs have the same basic elements, namely a club head, a shaft, a grip, and a counterweight. The weights and length of a set of clubs made according to the present invention is determined by an adjustment method and conversion formula developed by the inventors and set forth herein.

The force imposed upon a golf ball in actual practice depends upon a number of complex factors. If all other factors are constant, the force on the ball can be increased by either increasing the mass of the club head or increasing the velocity of the club head at the point of impact. It is more difficult to accelerate a heavy club head. Therefore, as the weight of the club head increases, a golfer will achieve a lower acceleration and velocity at the point of impact, if his effort is the same. More significantly, most golfers have a more difficult time controlling the swing of a club with a heavier club head. Therefore, a golfer's control of the club head and the flight of the ball generally decreases, as the mass of the club head increases.

Because of the problem of control, some golfers have used golf clubs having a lighter swing weight such as those in the mid C range on the lorythonic scale. These clubs are easier to control but ligher in total weight and have lighter club heads. Although they generate more club head velocity, they generally produce a loss in power.

Applicants have discovered that it is possible to produce a set of golf clubs which have swing weights lower than any known conventional clubs that have previously been on the market without any loss in power and distance. The clubs of the present invention in fact have swing weights that are so low that the swing weights are off the scale of standard lorythmic swing weight systems. The clubs of the present invention with these extremely low swing weights are significantly easier to control. In addition, the clubs of the present invention provide the power of conventional clubs with much higher swing weights. Applicants have provided this set of clubs by decreasing the weight of a conventional club head and have overcome the loss of power by adding a considerable mass in the form of counterweight 20 at the distal end of the shaft opposite the club head.

With reference to each of FIGS. 1 and 2, each club has a club head 10, a shaft 12 fixed to one end of the club head 10, and a grip 14 fixed to the shaft 12 at the other end of the shaft opposite the club head. As shown in FIG. 1 and 2, the grips of each of the clubs have a longitudinal midpoint 18 which is positioned approximately at the point where a golfer's hands will meet when he grips the club. A counterweight 20 is positioned behind the grip opposite the club head 10 and at the distal end of the shaft. As described in more detail below, the weight of each of the club heads 10 is determined by use of an adjustment method and a conversion formula. The counterweight 20 is chosen and interrelated to provide a set of clubs that provide increased control and excellent power. The resultant clubs made according to the present invention have extremely low swing weights and club head weights, when compared with conventional clubs, without suffering any loss in club head arch-weight and power.

Figure 3:
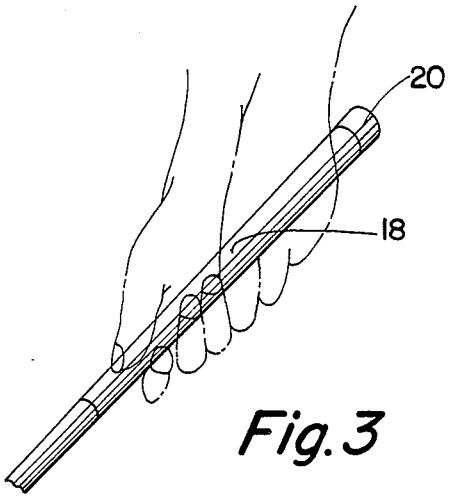
FIG. 3 is a perspective view showing a golf club of the present invention in the hands of a golfer.

As shown in FIG. 3, when a golfer grips the golf club of the present invention, his hands meet at approximately the midpont 18 of the grip. When the golfer swings the club, the club head of the club will swing from the starting position directly behind the ball, back to a rest position F (shown in FIG. 5) at the top of the swing, and then down through the ball and upward to an ending position D (shown in FIG. 5). The club head of a club, therefore, travels along an arch from point F through point D. The momentum of the club head depends upon the weight of the club head, its velocity, and the arch of the swing. While an increase in club head weight for a given velocity will increase the momentum and the force imposed on a ball, club heads with high club head weights are difficult to swing and to control.

Figure 4:
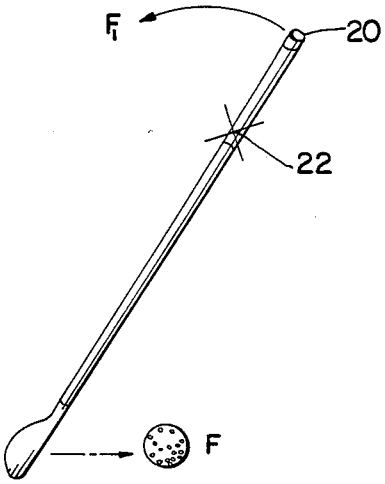
FIG. 4 is a diagram showing a golf club of the present invention and illustrating a principle of the present invention.
Figure 5:
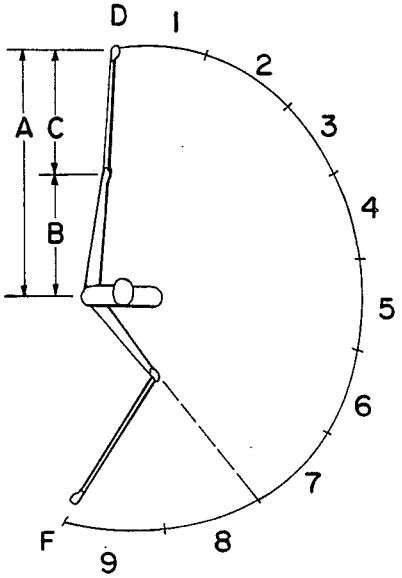
FIG. 5 is a diagram illustrating the counterweight arch and the club head arch and how the two are related.

The present invention overcomes the problems presented by heavy club heads by adding a counterweight to the distal end of the club and then decreasing the weight of the club head according to a conversion formula. The grip of a club, and therefore the counterweight of the present invention, however does not travel through the same path of the club head, since the wrist of a golfer breaks both during the backswing and the downswing. As shown in FIG. 5, the golfer's wrists and arms, the club head, grip, and the counterweight of the present invention travel through a forward arch from point E to point D. At approximately the point of impact, a golfer will rotate his wrists through the ball. At that point, the club in effect will tend to pivot about a point at or slightly below the midpoint of the grip. This relationship is shown generally in FIG. 4.

As shown in FIG. 5, the counterweight 20 is positioned at the distal end of the club and travels through arch E to D. The momentum of the counterweight traveling through the arch creates a arch force which is transferred through the club shaft and club head to the ball. This arch force adds to the force from a golfer's hands, arms, shoulders and body which is transferred through the shaft and club head to the ball. In addition, at or about the point of impact, as shown in FIG. 4, the counterweight 20 is rotated about the pivot point 22, which is approximately midpoint 18. The counterweight therefore also creates a counterforce F-1 which increases the ultimate force F imposed on the golf ball at impact. This counterweight provides a golfer with increased control throughout the swing and increases the golfer s ability to accelerate the club head to a higher velocity. The movement of the club head at a higher acceleration and velocity increases the force F imparted on the ball. At the point of impact the momentum force F-1 is effectively leveraged through the shaft to increase the force F on the ball.

To arrive at the present invention, applicants made significant variations in conventional golf clubs. Those variations include adding a counterweight to the distal end of the shaft and reducing substantially the weight of conventional club heads. Before describing the details of applicant's invention, it is first necessary to describe a conventional or standard set of clubs. In a conventional set of golf clubs, the higher numbered clubs, such as a wedge, have the shortest shaft and the heaviest club head weight. The clubs as they progress to lower numbered clubs have longer shafts and generally lighter club heads. In such a set, the shaft length of the clubs in inches are approximately as follows: driver: 43; number 2 wood: 42.5; number 3 wood: 42; number 4 wood: 41.5; number 1 iron: 39.5; number 2 iron: 39; number 3 iron: 38.5; number 4 iron: 38; number 5 iron: 37.5; number 6 iron: 37; number 7 iron: 36.5; number 8 iron: 36; number 9 iron: 35.5; wedge: 35; and sand wedge: 34.5. Convention sets of golf clubs have a lorythmic swing weight within the range of C+8 to D+3.

For instance, in one conventional set of clubs, the wedge in the low D range on the lorythmic scale has a shaft length of 35 inches, a club head weight of 294 grams, a standard shaft weight of 96 grams, and a grip weight of 48 grams. A driver club also in the low D range has a shaft length of 43 inches, a club head weight of 206 grams, a standard shaft weight of 114 grams, and a grip weight of 48 grams. The clubs between the wedge and driver of a conventional club set vary progressively through these extremes, the length of shaft increasing progressively as the club numbers decrease, while the weight of the club head tends to progressively decrease. The loft of conventional clubs progresses from approximately 54° for the number 11 club (sand wedge) to approximately 11° for the driver club. The loft decreases progressively at approximately 4° per club. The club head weights of a complete conventional set of clubs are described in the Table presented at page 24 of this application.

Applicants have developed a method of altering a conventional set of clubs into a set of clubs which comprise this invention. For the purpose of this application, a conventional set of clubs will be defined as a set of clubs which include a driver having a swing weight of between C+8 and D+3. The remaining clubs of a conventional set complement the conventional driver. In such a conventional set of clubs, the shaft of the driver has a length within the range of 43 to 43.5 inches. The shafts used for the wood-type clubs are typically more flexible than the shafts of the iron-type clubs. In such a conventional set of clubs, each club has a swing weight within the range of C+8 to D+3 on the lorythmic scale.

As disclosed more fully below, applicants arrived at the present invention by starting with a conventional set of clubs and creating a new set of clubs that represent a significant improvement over the prior art. In arriving at the preferred embodiment, applicants utilized an "arch weight" concept as an aid in determining how much to decrease the club head weight in order to complement the increase in club weight caused by the addition of a counterweight. Applicants, through experimentation, determined that the counterweight should preferably weigh between 90 and 116 grams to achieve the desired effect. Applicants further developed a conversion formula to determine the amount of decrease in the club head weight.

As shown schematically in FIG. 5, a golf club head 10 travels through an arch A having a radius roughly equal to sum of the length c of the club's shaft and the length b from a golfer's shoulder to the golfer's wrist. Roughly, the length b is approximately 25 inches, and the length c is that of the club. Therefore, the club head 10 will travel through an arch A having a radius roughly equal to the sum of 25 inches and the length of the club to be converted. For a standard club which does not include a counterweight, the arch-weight of the club is determined by multiplying the weight of the club head by the total length of the arch (25 inches plus the shaft of the club.)

$$Aw = Hwt \times (25 + c)$$

where:

Aw is the arch-weight;

Hwt is the club head weight; and c is the length of club shaft.

Since applicants' invention includes a counterweight, the effect of the counterweight must be considered when applying the concept of arch-weight. As shown in FIG. 5, the counterweight 20 will travel through an arch B having a radius of roughly 25 inches. The counterweight only travels through an arch from D to E while the the club head travels through an arch from D to F. The addition of the counter weight obviously is not the same as directly adding weight to the club head. However, the counter weight does add power to the club head.

Applicants have developed a formula, based on rough assumptions, which through experimentation and testing has proven to be helpful in their creation of an improved set of clubs. The counterweight travels through an arch with a radius b, rather than the arch of the club head with the radius A. The counterweight also travels through an arch which is approximately 7/9 of the arch of the club head, because a golfer breaks his wrist during the back swing. The arch-weight added at the club head by a counterweight is then estimated by the formula $$A_{wt}=Cwt[25/(c+25)]\times(7/9)$$

where $A_{wt}$ is the added arch-weight;

Cwt is the weight of counterweight; and c is the length of club shaft

Since the counterweight in effect adds this arch weight to the club head, the actual weight of the club head can be decreased by this added amount. For a given club which is to be converted to an improved club with the same shaft length, applicants use this formula to determine the new club head weight for a club which includes a counterweight and is meant to have the analagous power characteristics. Therefore, the converted head weight is determined according to the formula:

$$Hwt_2=Hwt_1-[Cwt\times(25/A)\times(7/9)]$$

where $Hwt_2$ is the converted club head weight;

$Hwt_1$ is the club head weight before conversion;

Cwt is the weight of the counterweight; and

A is the 25 inches plus c (the length of the club shaft).

By adding a counterweight within the range of 90 to 116 grams and applying the conversion formula and adjustment method, applicants have altered the conventional clubs by decreasing the weight of the conventional club heads by a substantial amount, preferably in the order of 22 to 34 grams, and adding a considerable counterweight, preferably in the order of 103 grams, at the distal end of the shaft opposite the club head. This drastic change in a conventional club set has provided a set of clubs with extremely low swing weights, without sacrificing power.

The set of clubs made according to the above conversion process provides a significant improvement over the prior art. In the preferred embodiment, applicants have included a further improvement by designing a set of clubs which provide the improved features without the need for the longer and more flexible shafts used with the wood-type clubs of conventional clubs. As described below, the driver club of the present invention has a total length within the range of 39.375 to 41.75 inches, most preferably about 40 inches. The number 3, 4 and 5 wood-type clubs also use shafts with shorter shafts. Moreover, the shorter shafts for the wood-type clubs preferably are stiffer shafts, the shafts of the entire club set having about the same shaft stiffness throughout the set.

As an example, the driver of applicants' invention preferably has a shorter shaft length (about 40 inches) than a conventional driver (43 inches). To convert a conventional 43 inch driver to a 40 inch driver according to the present invention, an adjustment must be made before the conversion formula is applied. The standard 43 inch driver converted by applicants had a club head weight of 206 grs. This driver would have an arch weight of $206\times(25+43)=14{,}008$ gram inches. Since the shaft is shortened by 3 inches, the club head of the shortened club should weigh more to offset the loss in arch radius. The new club weight is calculated according to the formula:

$$AHwt=CHwt\times[(25+c_1)/(25+c_2)]$$

where AHwt is the adjusted head weight;

CHwt is the conventional head weight;

$c_1$ is the conventional shaft length; and $c_2$ is the shortened shaft length.

In the example of converting a conventional driver which has a head weight of 206 grams and a shaft length of 43 inches into a club of the present invention having a counterweight of 103 grams and a shaft length of 40 inches, the weight of the head weight is first adjusted by the above formula to have an adjusted head weight of 215 grams:

$$AHwt=206\times(68/65)$$

$$AHwt=215$$

This adjusted head weight is then applied to the conversion formula at page 19 to determine the head weight of the driver of the present invention.

$$Hwt_2=215-[103\times(25/65)\times(7/9)]$$

$$Wwt_2=184.2$$

The resultant driver, as shown in the Table at page 24, has a head weight of 184.2 grams, a shaft length of 40 inches, a counterweight of 103 grams, a total weight of 419.69 grams, and a swing weight of A minus 22 on the lorythmic scale. The extremely low swing weight of the driver of the present invention was determined by interpolation.

Figure 6:
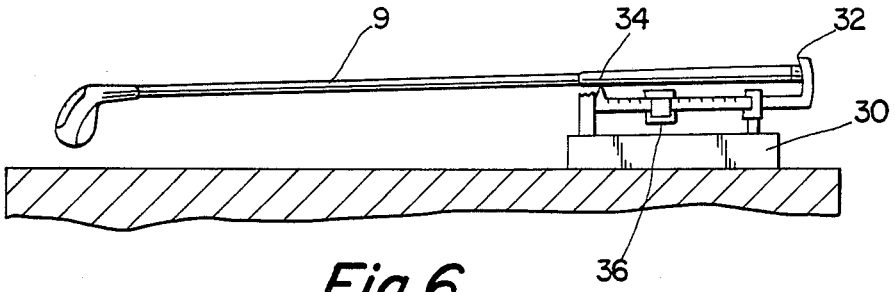
FIG. 6 is a diagram illustrating one device and method of measuring the basic swing weight of a golf club.
Figure 7:
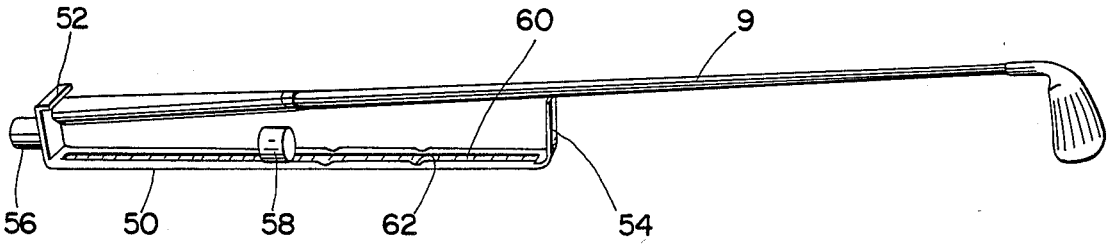
FIG. 7 is a diagram illustrating another device and method of measuring the swing weight of a golf club.

The Karsten scale described in the Background of the Invention section, as well as the scale shown in FIG. 6, do not include readings for swing weights below AO, since conventional clubs are all well above that range. The Karsten scale does, however, operate on a linear basis, and it is therefore possible to measure negative A swing weights with the Karsten scale which is readily available and which the applicants purchased from Karsten Manufacturing Company. By interpolation, applicants were able to determine the swing weight of the clubs described herein.

In the preferred embodiment, the lengths of the 3, 4 and 5 wood clubs according to the present invention also have shorter length shafts than conventional clubs, and are numbered as the invention clubs No. 1, 2 and 3 respectively. If the driver is shortened to 40 inches, then the number 1 club of the present invention (a 3 wood) is shortened to 39.5 inches, and the number 2 club of the present invention (a four wood) is shortened to 39. If the conventional wood-type head is used for the number 3 club (five wood), then it is shortened to 38.5 inches. This number 3 club with a wood-type head would replace the conventional 3 iron. The adjusted weight of the club heads of the number 1 through 3 club (the 3, 4 and 5 woods) with such shorter shaft lengths is determined by the same two step process just described for the driver.

The iron-type clubs in the preferred embodiment of the present invention, i.e. the 3 iron through the wedges, have shaft lengths which are the same as conventional clubs. Each iron of the present invention, however, has a counterweight that weighs the same as the counterweight used with the woods. As a result, the club head weight of the irons must be decreased according to the formula on page 19. For example, if a conventional wedge has a shaft length of 35 inches and a club head weight of 294 grams, the club head weight of the club would be:

$$Hwt_2=294-[103\times(25/60)\times(7/9)]$$

$$Hwt_2=260.7$$

The new weights of the other iron clubs are similarly calculated. A complete set of clubs made according to the present invention are described by the following chart.

tional clubs. The adjusted conventional club head weight (calculated from the formula at page 21) for the driver was 215 grams (adjusted from 206), for the number 1 woodtype club was 219.9 grams (adjusted from 212), for the number 2 wood-type club was 225.1 grams (adjusted from 217), and for the number 3 wood-type club was 230.4 grams (adjusted from 222).

The progressive range in swing weight is indicated on the chart. The swing weight ranges from AO minus 11.8 pts for the sand wedge to AO minus 22 pts for the driver. Because of this graduated and progressive swing weight, the longer a club is, the lighter it is. The longer clubs not only have lower swing weights but relatively lighter total weight as well. They are easier to control and have a greater potential club head velocity. The shorter clubs may be swung at a more deliberate tempo, with decreased velocity, but with more relative mass.

The swing weight on the driver is 55 points less than the conventional club, on the lorythmic scale. All the clubs have a counterweight with the same weight. The

PREFERRED EMBODIMENT

| Club No. | Conventional Club Head Weight | Invention Club Head Weight | Loft | Length | Grip Weight | Shaft Weight | Counter Weight | Swing Weight | Total Weight |
|---|---|---|---|---|---|---|---|---|---|
| DRIVER | 206 gr. | 184.2 gr. | 11° | 40" | 48 gr. | 84 gr. | 103 gr. | AO minus 22 pts. | 419.69 gr. |
| #1W | 212 | 188.9 | 16° | 39.5" | 48 | 82.9 | | AO −22 | 422.8 |
| #1I | 231 | 200 | 16° | 39.5" | 48 | 82.9 | 103 | AO −16.8 | 433.9 |
| #2W | 217 | 193.8 | 19° | 39" | 48 | 81.8 | | AO −22 | 426.6 |
| #2I | 238 | 206.7 | 19° | 39" | 48 | 81.8 | 103 | AO −15.6 | 439.5 |
| #3W | 222 | 198.9 | 22° | 38.5" | 48 | 80.7 | | AO −22 | 430.6 |
| #3I | 245 | 213.5 | 22° | 38.5" | 48 | 80.7 | 103 | AO −14.75 | 445.7 |
| #4I | 252 | 220.2 | 26° | 38" | 48 | 79.6 | 103 | AO −14.4 | 450.8 |
| #5I | 259 | 227 | 30° | 37.5 | 48 | 78.5 | 103 | AO −14 | 456.5 |
| #6I | 266 | 233.7 | 34° | 37" | 48 | 77.4 | 103 | AO −13.65 | 462.1 |
| #7I | 273 | 240.5 | 38° | 36.5" | 48 | 76.3 | 103 | AO −13.25 | 467.8 |
| #8I | 280 | 247.2 | 42° | 36" | 48 | 75.2 | 103 | AO −12.9 | 473.4 |
| #9I | 287 | 253.9 | 46° | 35.5" | 48 | 74.1 | 103 | AO −12.55 | 479 |
| #10I | 294 | 260.7 | 50° | 35" | 48 | 73 | 103 | AO −12.15 | 484.7 |
| 11I | 301 | 267.4 | 54° | 34.5 | 48 | 71.9 | 103 | AO −11.8 | 490.3 |

Since the No. 1, 2 and 3 clubs of the present invention may have wood-type or iron-type heads, both types of heads are included in the chart. The weights in Columns 2 shown as "W" are the conventonal head weights at the conventional length for the 3, 4 & 5 woods. (Designated the number 1 wood, number 2 wood, and number 3 wood, respectively). The weights in column 2 shown as "I" are the conventional iron head weights of conventional iron lengths. The driver is shortened by 3 inches, and the 3, 4 and 5 woods are shortened by 2.5 inches. The No. 1, 2 and 3 clubs having iron-type heads have heavier heads than the wood type heads, because the iron-type head is designed to strike the ball in a descending hit, instead of up. Extra weight is preferred for such a hit.

The grips of each of the clubs described in the chart have the same weight. Similarly, the counterweight for each club weighs the same, and is of the same general shape. The counterweight in each of the clubs has a dome shape and extends beyond the end of the grip by approximately three-eighths of an inch. The lengths shown in the chart are the lengths of the shafts only and do not include this additional ⅜ inch. The lorythmic swing weights shown in the chart do reflect the added ⅜" length, since swing weight was measured by placing the end of the shaft (including the counterweight dome) against a stop of the scale.

In the previous chart, the driver through number 3 wood-type clubs have shorter lengths than convenresultant clubs have a greater potential club head velocity without loss in club head arch weight. Also, the clubs reduce centrifugal force and minimize torque on the shaft. The extremely low weight of the club heads, when compared with a conventional set, greatly reduces the tendency of the toe of the club head to bend the shaft during the swing. The clubs are also easier to swing and control because of the lower weights, shorter lengths, and decrease in torque. In addition, since there is no loss in club head arch weight, the extra velocity generated produces extra energy and distance.

Applicants envision that the set of the present invention preferably includes a driver and wood-type heads with shorter shafts. It is preferable for the set of clubs to be progressively integrated in length, as well as loft, like the set described in the chart.

The invention clubs may vary slightly in swing weight, as is true with conventional clubs. The clubs preferably will not vary from the set shown in the chart by any more than 6 points (plus or minus) on the lorythmic scale. The swing weight of the clubs can be changed by changing the length, counterweight or club head weight. Generally, the swing weight of a club is changed one point on the lorythmic scale for every 2 grams of club head weight. Also, for every one-quarter inch change of length there is an approximate change of 1.5 points on the lorythmic scale. Similarly, for every 4.09 grams change in the counter weight there is an approximate one point change in swing weight. Therefore, the invention club's swing weight may be varied by any one, or a combination, of these three variables.

For instance, if a 3 point change in swing weight is accomplished by a change in the counter weight above, such change is done by adding, or subtracting 12.27 grams (3×4.09) to, or from the counter weight. If the same 3 points change is accomplished by club head weight alone, 6 grams should be added to, or reduced from, the club head weight.

To keep within the boundaries of the present invention, the club head weight of a driver made according to the invention should weigh less than 195.8 grams, and the sand wedge should have a club head weight of less than 279 grams. The counterweight should be at least 90 grams. The club head weight of the driver should be at least 172.6 grams, and the club head weight of the sand wedge should be at least 255.8 grams. Within this range, if it is desired to change the total weight of a club and still maintain the same swing weight for that club, the weight of the counterweight can be varied by 4.09 grams for every 2 grams of the club head. For example, the driver could remain at AO minus 22 points by adding 2 grams to the club head and adding 4.09 grams to the counterweight.

Iron type shafts are preferred for all clubs in the set, that is, shafts that are generally stiffer than regular wood type shafts. It is unnecessary to have the more flexible shafts like the wood shafts because the invention creates the potential for velocity without the whipping action of such a shaft. The stiffer shafts are also much more accurate. Generally, the iron type shafts are heavier, per inch, than the wood-type shaft. For instance, one wood shaft, if trimed to 39″ weighs 101 grams, whereas, the iron shaft of the same flex and length weighs 113 grams. Also, the weight of a "RS" flex wood type shaft will weigh about the same as a more flexible "A" iron type shaft. For example, one such "RS" wood type shall at 39″ weighs 103 grams, while the "A" flex iron type shaft also weighs 103 grams. Of course, the wood type shaft can be stiffened to that which would approximate an iron type shaft by triming the tip end. Such a shaft could be similar to an iron type shaft. It is preferred however that all the clubs have the same iron type shafts.

The iron type shaft, at 39″, should preferably weigh less than 103 grams, and most preferably less than 95 grams. The use of lighter weight shafts reduces the overall weight of the invention club, which is of advantage to the invention. An "A" flex iron type shaft was used in the preferred set of clubs shown in the charts. The "A" flex shaft is preferred because it is more flexible than the "R" (regular) flex used in most conventional clubs. However, because of the extremely low swing weight and the lower head weights of the invention clubs, the A flex shafts have been found to provide the preferred flex for normal use.

Other variations may be made in length and loft. However, it is preferrable for the set of clubs to be progressively integrated and continuous in length as well as loft, like the set described in the chart.

The clubs of the present invention have lighter club head weights, thereby promoting greater acceleration and velocity at the point of impact. The clubs also produce less centrifugal force at the grip and less momentum of the club head at the other end of the shaft, thereby making it easier for the golfer to control the swing of the club head. In addition, the combination of the lower weight of the club head and the counter-momentum of the counterweight allow the golfer to swing the club head at a greater velocity. This increased velocity and the additional leveraged force from the counterweight allow a golfer to hit the ball with a strong force at the point of impact and offset the loss of force otherwise caused by the decreased in weight of a standard club head.

The clubs of the present invention have considerably heavier total weight, when compared to clubs of a conventional set. Through their analysis and experimentation, applicants have concluded that each club of the present invention preferably should have a club head weight that is less than 279 grams. The driver club should preferably have a club head weight of less than 195.8 grams and the club head weights between the driver, and the No. 9 clubs should have progressively increasing club head weights which range between less than 195.8 grams for the driver and less than 265.5 grams for the No. 9 clubs. For clubs having shafts of the more conventional weight, for example the shaft of a 40″ driver weighing 103 grams, applicants have concluded that each club of the set should preferably have a total weight of at least 430 grams, and that clubs of the set have progressively increasing total weights which range between at least 430 for the driver club and at lest 479 grams for the No. 9 club.

Applicants are aware of light weight shafts which for the driver club would have a weight as low as 65 grams. For clubs having such light weight shafts, applicants have concluded that each club of the set should preferably have a total weight of at least 392 grams, and that the clubs should have progressively increasing total weights which range between at least 392 grams for the drive club and at least 446 grams for the No. 9 club. It should be clear, however, that even with such extremely light shafts, the total weight of the respective clubs of the present invention would be more than the weight of a set of conventional clubs. For example, the driver of conventional clubs normally have a total weight within the range of 350 to 370 grams, while the 40″ invention driver is still at least 22 to 42 more, even with extremely light weight shafts.

The invention provides both increased total weight and increased control, qualities not found possible by either adding or subtracting weight to or from the club head itself. Also, the club head arch-weight is at least the same as compared with conventional clubs.

It is preferable that the counterweight be symmetrical about the longitudinal axis of the club's shaft. This positioning provides the best balance and control. Certain embodiments of the counterweight are disclosed in FIGS. 8–10.

Figure 8:
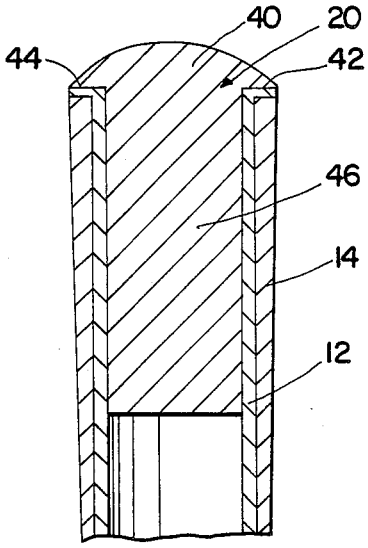
FIG. 8 is a partial cross-sectional view illustrating one embodiment of the counterweight system which is a part of the present invention.

One embodiment of the counterweight is disclosed in FIG. 8. In FIG. 8, the counterweight 20 is fixed to the distal end of the shaft itself and includes a dome cap 40, flanges 42 and 44, and a cylindrical insert 46. Dome cap 40 is approximately 1⅛ inches in diameter and has a depth of less than ⅜ inch, and the insert 46 has a length of less than 1 and 154 inch. In use, the cylindrical insert 46 is inserted into the shaft 12 until the flanges 42 and 44 abut against the end of the shaft and the grip. The counterweight can be fixed to the shaft by conventional means, such as glue, friction fitting, etc. The counterweight as shown in FIG. 8 has a weight of at least 90 grams. The counterweight preferably is made from a metal material having a high density and preferably has a total length of less than 16/8 inches.

Figure 9:
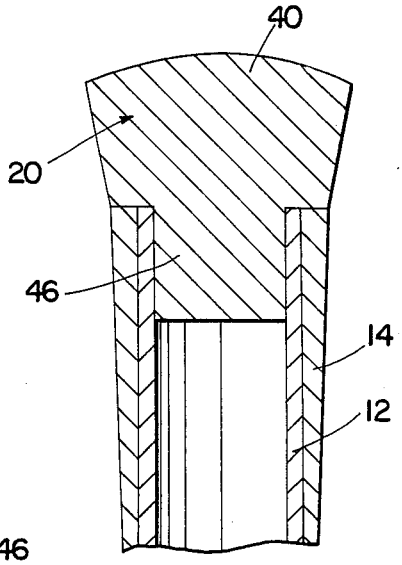
FIG. 9 is a partial cross-sectional view illustrating another embodiment of the counterweight system which is part of the present invention.
Figure 10:
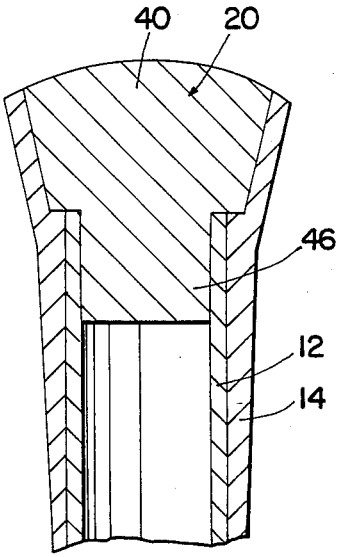
FIG. 10 is a partial cross-sectional view illustrating still another embodiment of a counterweight system which is molded within a golf club grip.

Other embodiments of the counterweight are shown in FIGS. 9 and 10. As shown in those figures, the counterweight can have a variety of shapes and can be fixed either to the shaft of the club or to the grip of the club head. The counterweight 20 shown in FIG. 9 is similar to that shown in FIG. 8 and has a dome 40 and an insert or stem 46 which is fixed to the shaft 12. The dome of the counterweight shown in FIG. 9 has a length in range of ⅜ inch to ½ inch, is approximately 15/16 inches in diameter, with insert 46 less than ½ inch and therefore provides a large mass at the very end of the shaft. The addition of this counterweight to the club effectively decreases the swing weight of the club and increases the distance between the pivot point 22 of the club and the center of gravity of the counterweight. Thus, the leverage of the counterforce F-1 illustrated in FIG. 4 is increased by lengthening the dome of the counterweight.

In FIG. 10, the counterweight 20 also includes a dome 40 and an insert 46, but the counterweight shown in FIG. 10 is fixed directly to the grip and becomes part of the grip. That counterweight has a size and shape similar to that of the counterweight shown in FIG. 9. In use, however, the grip and counterweight are a unit so that the grip and counterweight are fixed to the club shaft in a single operation.

Applicants presently prefer the embodiments shown in FIGS. 9 and 10, where the counterweight extends beyond the end of the shaft and is wider in diameter than the shaft.

It will be apparent to those skilled in the art that various modifications and variations can be made of the present invention in view of the above teachings. It is intended that the specification and examples be considered as exemplary only, the true scope and spirit of the invention to be indicated by the following claims.

What is claimed is:

1. A set of numbered golf clubs including a driver and a 9 iron, the set comprising:

a plurality of progressively lofted clubs, each club having a club head, a shaft fixed at one end of the club head and a grip fixed to the shaft at the other end;

a counterweight positioned at the distal end of the shaft opposite each of the respective club heads, said counterweight weighing at least 90 grams;

the weight of the club head of each club progressively increasing as the number of the club increases, the weight of the club heads falling within the range of no greater than 195.8 and no less than 172.6 grams for the driver and no greater than 265.5 and no less than 242.3 grams for the 9 iron; and the swing weight of the clubs progressively increasing as the number of the club increases, the swing weight of the clubs falling within the range of less than AO minus 16 points on the lorythmic scale for the driver and less than AO minus 6.75 points on the lorythmic scale for the 9 iron.

2. The set of clubs of claim 1 wherein the driver through 9 clubs progressively increase in total weight between the range of at least 392 grams for the driver to at least 446 grams for the 9 iron.

3. The set of clubs of claim 2 wherein the driver through 9 clubs progressively decrease in shaft length between the range of 41.75 to 35 inches.

4. The set of clubs of claim 1 wherein the shafts of each club of the set has substantially the same stiffness.

5. The set of clubs of claim 4 wherein the shafts of each club has a length of less than 41.75 inches.

6. The set of golf clubs of claim 1 wherein the weight of the counterweight of each club is the same.

7. The set of golf clubs of claim 1 wherein the set includes a driver and a number 1 through 9 club and wherein the swing weight of the driver club is no greater than AO minus 16 on the lorythmic scale, the swing weight of the No. 1 club is no greater than AO minus 11 on the lorythmic scale, the swing weight of the No. 2 is no greater than AO minus 9.8 on the lorythmic scale, the swing weight of the No. 3 club is no greater than AO minus 8.95 on the lorythmic scale, the swing weight of the No. 4 club is no greater than AO minus 8.6 on the lorythmic scale, the swing weight of the No. 5 club is no greater than AO minus 8.2 on the lorythmic scale, the swing weight of the No. 6 club is no greater than AO minus 7.85 on the lorythmic scale, the swing weight of the No. 7 club is no greater than AO minus 7.45 on the lorythmic scale, the swing weight of the No. 8 club is no greater than AO minus 7.1 on the lorythmic scale and the swing weight of the No. 9 club is no greater than AO minus 6.75 on the lorythmic scale.

8. The set of golf clubs of claim 7 wherein the the set further includes a number 10 and a number 11 club and wherein the swing weight of the No. 10 club is no greater than AO minus 6.35 on the lorythmic scale and the swing weight of the No. 11 club is no greater than AO minus 6 on the lorythmic scale.

9. The set of golf clubs of claim 7 wherein the set includes a driver through a number 9 club, the driver and the number 1, 2 and 3 clubs have wood-type heads, the number 4 through 9 clubs have iron-types heads, and wherein the club head weight for the respective clubs is within the following ranges in grams: driver: 172.6 to 195.8; number 1: 177.3 to 200.5; number 2: 182.2 to 205.4; number 3: 187.3 to 210.5; number 4: 208.6 to 231.8; number 5: 215.4 to 238.6; number 6: 222.1 to 245.3; number 7: 228.9 to 252.1; number 8: 235.6 to 258.8; number 9: 242.3 to 265.5.

10. The set of golf clubs of claim 7 wherein the set includes a driver through a number 9 club, the number 1 through 9 clubs have iron-type heads and wherein the club head weight for the respective clubs is within the following ranges in grams: driver: 172.6 to 195.8; number 1: 188.4 to 211.6; number 2: 195.1 to 218.3; number 3: 201.9 to 225.1; number 4: 208.6 to 321.8; number 5: 215.4 to 238.6; number 6: 221.1 to 245.3; number 7: 228.9 to 252.1; number 8: 235.6 to 258.8; and number 9: 242.3 to 265.5.

11. The set of golf clubs of claim 1 wherein the set includes a driver through a number 9 club, the driver and the number 1, 2 and 3 clubs have wood-type heads, the number 4 through 9 clubs have iron-type heads, and wherein the club head weight for the respective clubs is within the following ranges in grams: driver: 172.6 to 195.8; number 1: 177.3 to 200.5; number 2: 182.2 to 205.4; number 3: 187.3 to 210.5; number 4: 208.6 to 231.8; number 5: 215.4 to 238.6; number 6: 222.1 to 245.3; number 7: 228.9 to 252.1; number 8: 235.6 to 258.8; number 9: 242.3 to 265.5.

12. The set of golf clubs of claim 11 wherein the set further includes a number 10 and a number 11 club and wherein the club head weight of the number 10 club is within the range of 249.1 to 272.3 grams and the club head weight of the number 11 club is within the range of 255.8 to 279 grams.

13. The set of golf clubs of claim 1 wherein the set includes a driver through a number 9 club, the number 1 through 9 clubs have iron-type heads and wherein the club head weight for the respective clubs is within the following ranges in grams: driver: 172.6 to 195.8; number 1: 188.4 to 211.6; number 2: 195.1 to 218.3; number 3: 201.9 to 225.1; number 4: 208.6 to 231.8; number 5: 215.4 to 238.6; number 6: 221.1 to 245.3; number 7: 228.9 to 252.1; number 8: 235.6 to 258.8; and number 9: 242.3 to 265.5.

14. The set of golf clubs of claim 13 wherein the set further includes a number 10 club and a number 11 club and wherein the club head weight of the number 10 club is within the range of 249.1 to 272.3 grams and the club head weight of the number 11 club is within the range of 255.8 to 279 grams.

15. A set of numbered golf clubs including a driver and a 9 iron, the set comprising:

a plurality of progressively lofted clubs, each club having a club head, a shaft fixed at one end to the club head and a grip fixed to the shaft at the other end;

a counterweight positioned at the distal end of the shaft opposite each of the respective club heads, said counterweight weighing at least 90 grams;

the weight of each shaft of the clubs being within the range of 57.5 to 103 grams;

the length of the shaft of each club progressively decreasing as the number of the club increases, the length of the shafts being within the range of 41.75 to 34.5 inches;

the weight of the club head of each club progressively increasing as the number of the club increases, the weight of the club heads falling within the range of 172.6 to 279 grams;

the weight of each club grip being substantially the same for each club and being within the range of 45 to 60 grams;

the swing weight of the clubs progressively increasing as the number of the club increases, the driver club having a lorythmic swing weight of AO minus 16 points or less and the number 9 club having a lorythmic swing weight of AO minus 6.75 or less.

16. The set of golf clubs of claim 15 wherein each club of the set has a different total weight.

17. The set of golf clubs of claim 15 wherein the weight of the counterweight of each club is the same.

18. The set of golf clubs of claim 17 wherein the counterweight is fixed directly to the shaft of the respective golf club.

19. The set of golf clubs of claim 17 wherein the counterweight is fixed to the distal end of the grip of the respective golf clubs.

20. The set of golf clubs of claim 17 wherein each club has a length of at least 34.5 inches.

21. The set of golf clubs of claim 20 wherein each club has a club head weight that is less than 279 grams.

22. The set of golf clubs of claim 21 wherein the club head weight of the driver club is less than 195.8 grams and the club head weight of the No. 9 club is less than 265.5 grams.

23. The set of golf clubs of claim 17 wherein the counterweight is symmetrically positioned about the longitudinal axis of the shaft of each respective club.

24. The set of golf clubs of claim 15 wherein each club has a total weight of at least 392 grams.

25. The set of golf clubs of claim 15 wherein the clubs between the driver and No. 9 club have progressively increasing total weights which range between at least 392 for the driver club and at least 446 grams for the No. 9 club.

26. The set of golf clubs of claim 25 wherein the maximum total weight of the clubs ranges between no greater than 461 grams for the driver and no greater than 516.5 grams for the number 9 club.

27. The set of golf clubs of claim 15 wherein the counterweight has a length along the longitudinal axis of said shaft of less than one and ¾ inches.

28. The set of golf clubs of claim 15 wherein said counterweight includes a crown and a reverse ledge which fits over the distal end of the grip.

29. The set of golf clubs of claim 15 wherein each club has a shaft having the same flexing properties.

30. The set of golf clubs of claim 15 wherein the lorythmic swing weight of the driver is within the range of A minus 16 points to A minus 28 points and the lorythmic swing weight of the number 9 club is within the range of A minus 6.75 points to A minus 18.35 points.

* * * * *